United States Patent [19]

Kuenzig

[11] Patent Number: 4,566,601

[45] Date of Patent: Jan. 28, 1986

[54] TAMPERPROOF CONTAINER NECK CONSTRUCTION

[76] Inventor: Ernest O. Kuenzig, 32 Waverly St., Glen Head, N.Y. 11545

[21] Appl. No.: 640,341

[22] Filed: Aug. 13, 1984

[51] Int. Cl.[4] ..... B65D 41/48

[52] U.S. Cl. ..... 215/31; 215/252; 215/256; 220/72

[58] Field of Search ..... 215/31, 252, 253, 254, 215/258, 317, 321, 224, 256; 220/72

[56] References Cited

U.S. PATENT DOCUMENTS

| | | | |
|---|---|---|---|
| 3,045,887 | 7/1962 | Craine | 220/72 X |
| 3,303,964 | 2/1967 | Luker | 220/72 X |
| 3,720,343 | 3/1973 | Irish, Jr. | 215/256 X |
| 3,784,040 | 1/1974 | Douglas | 215/31 |
| 3,980,195 | 9/1976 | Fillmore | 215/256 |
| 4,166,552 | 9/1979 | Faulstich | 215/256 |
| 4,209,101 | 6/1980 | Brown | 215/253 |
| 4,225,050 | 9/1980 | Reinhart | 215/252 |
| 4,423,820 | 1/1984 | Vangor | 215/252 |
| 4,438,857 | 3/1984 | Bullock, III | 215/256 |
| 4,484,687 | 11/1984 | Bullock, III | 215/256 |
| 4,496,066 | 1/1985 | Bullock, III | 215/31 X |

*Primary Examiner*—Steven M. Pollard

*Attorney, Agent, or Firm*—Eliot S. Gerber

[57] ABSTRACT

A plastic cap has a tearable outer skirt depending from a top disc, the interior of the skirt having means engaging with cooperating means on a container neck to hold the cap in place until the lower portion of the skirt is torn. To prevent dishonest persons from defeating the tamper resistant character of the cap by prying upward on the bottom edge of the cap skirt, a shoulder has been formed on the neck fitting closely under the bottom edge of the cap skirt. To further reduce such prying, a series of protrusions is formed on the shoulder with spaces between the protrusions. The protrusions inhibit fingernails from access to the lower edge of the skirt. The bumper ring which cooperates with loading grippers is interrupted by straight sections which prevent collapse of the bumper ring when the cap is applied.

13 Claims, 5 Drawing Figures

TAMPERPROOF CONTAINER NECK CONSTRUCTION

BACKGROUND OF THE INVENTION

This invention relates to a new and improved tamperresistant container neck construction.

1. Field of Invention

The present invention relates to a plastic bottle neck preferably of a blow-molded, thin-walled type used to package milk, water and other liquid, particularly in retail stores. Such containers have been manufactured with increasingly thinner walls. The thinner the wall, the more prone the neck is to deformation. A plastic bottle cap fits over the neck and engages therewith by means of beads on the interior of the skirt of the cap engaging in grooves in exterior wall of the neck or other means. When the cap is intact, the closure of the cap and neck is said to be "tamper-resistant" in the sense that the skirt of the cap must be at least partially torn away in order to remove the cap and provide access to the contents of the container. When the container neck is made very thin the possibility of prying the cap off the neck because the thin-walled neck is subject to deformation, has become a problem. The present invention inhibits dishonest persons from removing the cap without tearing the skirt thereof.

Another problem arising from the use of thin-walled necks occurs when the cap is applied to the container at the bottling works. Downward pressure is applied to the cap, causing the cap and neck to deform to permit the beads of the cap to snap over the neck and engage in the grooves thereof. The present invention provides a deformable outward bulging "bumper" ring below the neck which is interrupted by straight-walled sections which prevents collapse of the neck when the cap is applied.

Although especially intended for use in thin-walled containers, the invention has utility in thicker bottles.

2. Description of the Prior Art

The cap of the present invention is subject to considerable variation. One preferred cap form with which the neck construction is usable is shown in U.S. Pat. No. 4,202,455. The cap shown in that patent is an improvement upon an earlier U.S. Pat. No. 3,338,446. The caps function in that they have a top disc from which depend an inner skirt which fits within and seals against the inside of the container neck and an outer skirt which fits around the container neck. The outer skirt has internal beads which fit into the grooves in the exterior of the neck. Such beads may be continuous or interrupted. The outer skirt also has a circumferential scoreline intermediate the beads and a second scoreline extending down from the first mentioned scoreline to the bottom edge of the skirt. A tear tab on the bottom edge of the skirt may be gripped by the user and torn upward, causing the cap to tear along the second scoreline and thence around circumferential scoreline. Such tearing of the skirt removes one of the two beads which hold the cap in place. With only one bead remaining, the upper portion of the cap becomes a reclosure cap which may be repeatedly pried off the neck and replaced until the container is discarded.

The present invention is used with a typical cap of this type and variations thereof.

To prevent dishonest patrons prying the cap off by inserting the fingernails under the bottom edge of the cap, a horizontal shoulder has been formed on necks immediately below the bottom edge of the skirt, as shwon for example in U.S. Pat. No. 4,438,857. The present invention comprises an improvement upon such structure.

OBJECT OF THE INVENTION

A principal purpose of the present invention is to provide a neck construction for a container of the type having a horizontal shoulder on which the bottom edge of the cap skirt rests which is provided with narrow, spaced-apart outward protrusions around the circumference of the shoulder. These protrusions are narrow enough, as are the spaces between the protrusions so as to make it virtually impossible for the fingernails of a dishonest patron being inserted under the skirt to pry up the lower edge of the skirt. These protrusions also make it difficult to use other prying means readily availble to a dishonest patron of a supermarket or other retail establishments without damaging the skirt and providing evidence of tampering.

Another object of the invention is to provide an interrupted outwardly bulging bumper ring in the neck construction below the aforesaid shoulder. Such a ring is used with grippers of automatic loading machines. Straight sections between bulging sections prevent collapse and function to absorb some of the force which is applied to the neck when the cap is applied thereto. The use of the protrusions on the shoulder and the straight sections of the bumper ring permit thinner container walls without a danger either of the tamperproof character of the construction being impaired or the container neck being deformed during application of the cap.

SUMMARY OF THE INVENTION

The present invention is used with a plastic cap of the type having a top disc formed with an outer skirt. In a preferred cap, the outer skirt is smooth on the outside and is formed with at least one internal bead on the inside. Further, there is a circumferential tear line formed in the outer skirt and means for tearing away the outer skirt below such tear line. In a preferred cap there may be a second scoreline extending from the first mentioned line down to the bottom edge of the outer skirt. A tear tab may extend from the outer skirt adjacent the second scoreline to facilitate tearing the skirt upwardly along the second scoreline and then circumferentially around the first mentioned scoreline, leaving a reclosure cap. The two scorelines may be circumferential and the skirt may be torn away in a horizontal band between the lines. The cap may have an inner skirt or plug within the outer skirt.

The container neck is preferably of a plastic which may be blow-molded, having a neck complementary to the inside of the outer skirt and having sealing surfaces which engage the inner skirt to provide a fluid-tight seal. The neck has an outward extending horizontal shoulder immediately below the bottom edge of the outer skirt provided with narrow outward protrusions separated by narrow gaps distributed uniformly around the circumference of the shoulder to inhibit use of the fingernails or conventional prying instruments to remove the cap from the neck before the outer skirt has been torn away.

Other objects of the present invention will become apparent upon reading the following specification and referring to the accompanying drawings in which similar characters of reference represent corresponding parts in each of the several views.

DETAILED DESCRIPTION OF A PREFERRED EMBODIMENT

Figure 1:
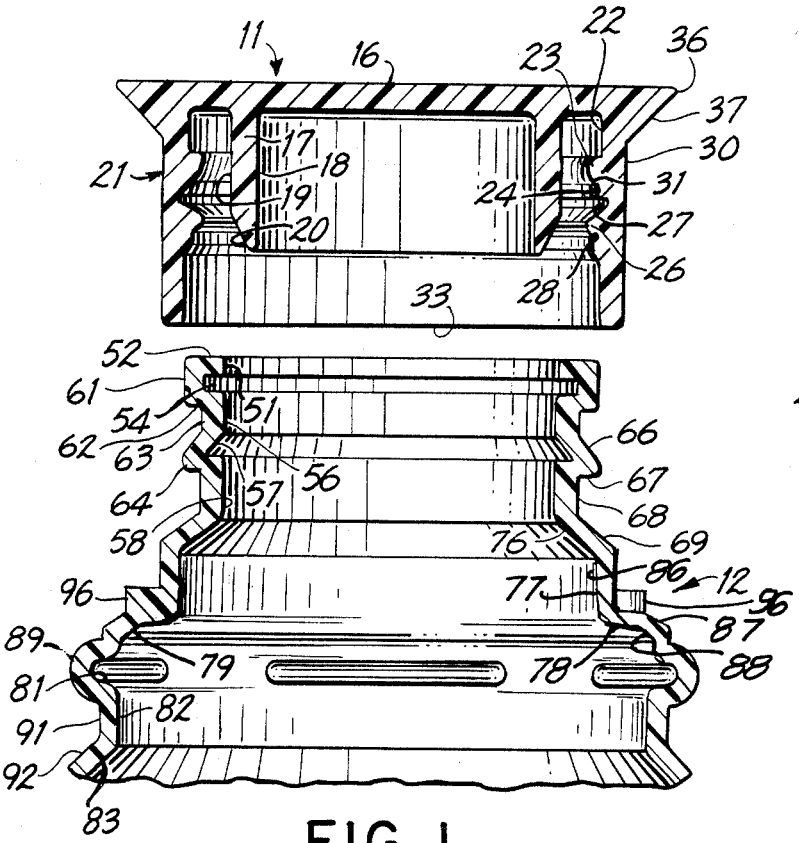
FIG. 1 is an exploded sectional view through the cap and the neck of the container prior to assembly.

A specific cap 11 is illustrated and described herein, it being understood that such cap is subject to variation. The neck of the container 12 is formed to accomplish a tight seal with cap 11 and, hence, may be varied as the cap is varied. Cap 11 comprises a top disc 16 having a preferably flat top and bottom surface. In one form of the invention depending from the underside of disc 16 is an interior skirt 17, which is relatively short, having a substantially vertical inner wall 18 and outer wall 19 and an inwardly-downwardly tapered edge 20.

Spaced outwardly from the inner skirt 17 is an outer skirt 21 which has a substantially vertical, smooth outer wall 30. The inner wall of skirt 21 has means for securing cap 11 on the neck of container 12, such means being subject to some variation.

The inner wall of outer skirt 21 extends downward from disc 16, preferably having a substantially vertical top stretch 22 which terminates in an internal bead 23. Below bead 23 is an intermediate vertical wall 24 which terminates in an internal lower bead 26. Bead 26 has a slightly downwardly-inwardly slanted top surface 27 which merges with a substantially downward-outwardly inclined lower surface 24. The beads 23 and 26 are preferably not continuous (i.e., are not circumferential) but are interrupted, as, for example, shown in U.S. Pat. No. 4,202,455. In other words, there are gaps between bead sections (not shown) both of the upper bead and lower bead. The interruptions in the beads permit the skirt to stretch during capping, hence, permit thinner wall sections for the neck 12.

Spaced immediately above the top surface of bead 26 is an internal horizontal scoreline 31 formed on the interior of skirt 21 to permit tearing. Extending upwardly preferably in a slightly spiral configuration from the bottom edge 33 of skirt 21 is a second, internal scoreline 32 which merges with the scoreline 31. A tear tab 34 is located to one side of the scoreline 32 and may easily be gripped with the fingers. To facilitate such gripping, transverse ridges 35 may be formed thereon.

The lower portion of skirt 21 may be completely torn off, as is explained in the aforementioned patents, leaving a reclosure cap on the upper part of the bottle neck 12. A peripheral flange 36 is an outward extension of top disc 16 and may be used to pull the reclosure cap off the neck 12. The flange 36 may be formed in various ways, but the preferred form shown in the drawings is the provision of an undersurface 37 which slants downwardly-inwardly at about a 45° angle from the extreme outer edge of flange 36, intersecting the outer surface 30 of skirt 21. Such structure thwarts efforts to tamper with the contents of the container before the skirt 21 has been torn.

Neck 12 is likewise subject to variation but preferably has a top, inwardly turned flange 51, having a short horizontal top surface 52 which is of a width slightly less that the distance between the skirts 17 and 21.

Describing, first, the interior of neck 12, proceeding downwardly from flange 51, there is a groove 54 which separates the flange 51 from a second sealing surface 56, which is of lesser diameter than the exterior 19 of inner skirt 17. Sealing surface 56 engages outside surface 19 of inner skirt 17, as does the inner edge of the flange 51. Below surface 56 is a second outwardly extending groove 57 and below groove 57 is another substantially vertical surface 58. Below surface 58 the interior of the neck slants downwardly-outwardly in a stretch 76 which terminates in a vertical stretch 77. At the bottom of surface 77 is a horizontal outwardly directed shoulder 78, hereinafter described in greater detail. Beyond the shoulder 78 is a downward outwardly slanted surface 79 which terminates in interrupted bumper ring 81. As illustrated, there are four circumferentially spaced apart outward-bulging bumper ring sections 81 having approximately semi-circular cross-section inner surfaces. Below the area of the bumper ring 89 is a vertical surface 82 and below the latter is an outwardly-downwardly slanted surface 83 which merges into the walls (not shown) of the container below the neck 12.

One of the important features of the inventions is the provision of a plurality of circumferentially spaced apart protrusion 96 which extend outward of the inner wall of the neck immediately above the horizontal shoulder 78. In a preferred embodiment, the exterior of the protuberances is semi-circular. In such preferred embodiment the protuberances extend outward approximately 0.065 inches and are of a height approximately 0.037 inches for a shoulder area where the outside diameter of the protuberances 96 is 1.500 inches.

Directing attention now to the exterior of neck 12, extending vertically downward from surface 52 is an external first vertical surface 61 which terminates in a sharp angle with horizontal-inwardly extending shoulder 62. The length of surface 61 is such that the bead 23 of cap 11 in assembled condition seats immediately below the shoulder 62 and holds the cap in place even when the score line 31 has been torn. Thus, the bead 23 and shoulder 62 keep the reclosure cap in place.

Below shoulder 62 a second vertical surface 63 which is of substantially lesser diameter than surface 61. Surface 63 terminates in external bead 64. Bead 64 has an outwardly-downwardly slanted upper surface 66 (at about 48° with the horizontal and approximately parallel to surface 28) which is rounded at its outer edge and merges with lower horizontal shoulder 67. Below bead 64 is a third vertical surface 68 which merges with outwardly-downwardly slanted surface 69 at an angle of about 35° with respect to the horizontal. Surface 69 terminates in a vertical surface 86 of approximately the same outside diameter as beads 64 and surface 61. At the bottom of surface 86 is horizontal shoulder 78. Below shoulder 78 is an outwardly-downwardly slanted surface 87 at about 30° with respect to the horizontal).

Located below the surface 88 are automatic loading machine gripping members 89 or "bumper ring" sections, which are complementary to the surface 81. The gripping members 89 are shown here as four in number spaced around the vertical surface 91. The gaps between the gripping members 89 provide rigidity to the neck, so that when the cap 11 is forced down over the neck 12 the neck does not collapse, as might otherwise be the case if the bulging gripping members 89 were continuous. Below vertical surface 91 is a slanted surface 92 which merges with the major portion of the container (not shown) on which the neck 12 is formed.

An important feature of the present invention is the provision of protuberances 96 extending upward from shoulder 78. Viewed from the exterior, these protuberances 96 are rounded and are separated by gaps 97 which are approximately the same length as the protuberances 96. The lower edge 33 of skirt 21 rests tightly upon the top of the protuberances 96 so that one cannot dig ones fingernails under the edge 33 to pry off the cap before the cap has been torn. If an instrument such as a fingernail file were inserted in one of the spaces 97, the cap would be damaged to reveal the fact that someone had tampered with the seal.

Figure 2:
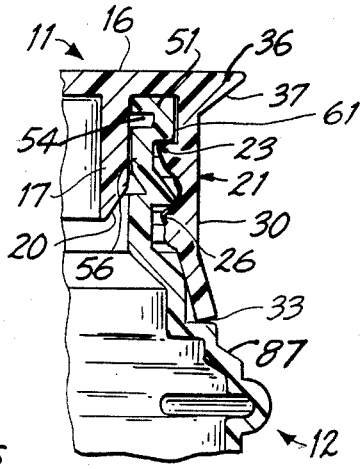
FIG. 2 is a fragmentary view similar to a portion of FIG. 1 showing the cap installed on the neck.
Figure 3:
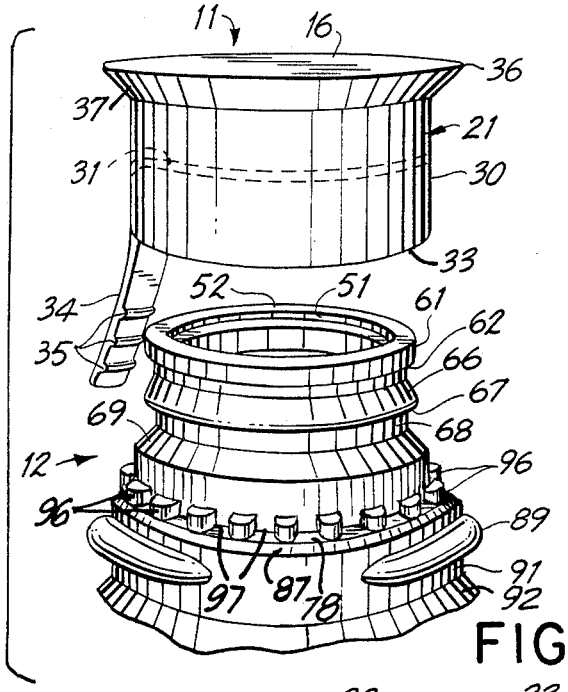
FIG. 3 is an exploded perspective view of a cap and the container neck before assembly.
Figure 4:
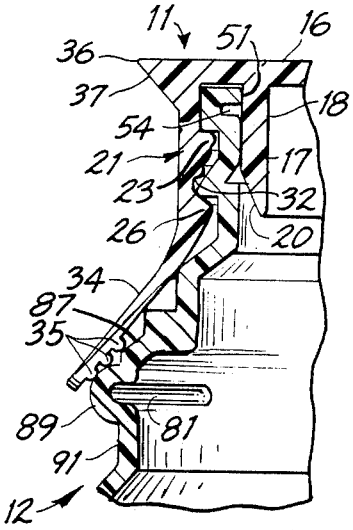
FIG. 4 is a view similar to FIG. 2 turned so as to show the location of the tear tab relative to the shoulder and protrusions.
Figure 5:
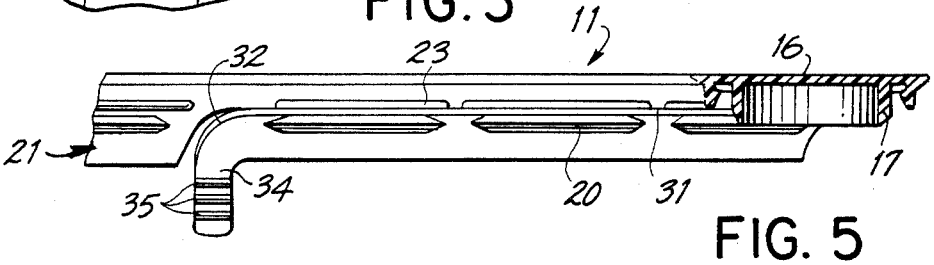
FIG. 5 is a sectional view of a cap showing the tear strip developed in a plane.

In assembly of cap 11 on neck 12 (i.e., the downward movement of cap 11 from the position of FIG. 1 to the seated position of FIG. 2), the skirt 21 stretches to permit lower bead 26 to slide over first the corner where the surfaces 52 and 61 intersect and then to slide over bead 64. Similarly, bead 23 slides over the corner where surfaces 52 and 61 intersect. In the seated position of FIG. 2, bead 23 is seated under shoulder 62 and bead 26 is seated under shoulder 67. Accordingly, there are several locations of sealing surfaces which prevent leakage of liquid from the container 12. The first such sealing surface is where the surface 56 engages the surface 20. The second such sealing surface is where the inner edge of flange 51 engages the outside of the skirt 18. An additional sealing surface is where bead 23 engages surface 62 and again where bead 26 engages bead 64.

The beads 23 and 26 may be continuous, extending circumferentially around the inside of the skirt 21, or they may be interrupted, such as shown in U.S. No. 4,162,736 and 4,166,552.

Until the outer skirt 21 is torn, cap 11 cannot be removed from the bottle neck 12 without deforming the neck 12. Attempting to pry the cap off by digging the fingernails under the lower edge 33 of skirt 21, is inhibited by the protuberances 96 on the shoulder 97, the lower edge 33 fitting tightly against the tops of the protuberances 96. If an instrument were inserted in the spaces 97 between the protuberances 96, the neck 12 or bottom edge 33 of the skirt would be damaged, giving proof that the user had tampered with the contents.

Attempting to pull upwardly on the cap 11 is frustrated by the outward-upward slanted surface 37.

When the user wishes to open the container, he first grips tab 34 and pulls upwardly, causing the skirt 21 to tear along scoreline 32 and then along scoreline 31, so that all of the cap below scoreline 31 (including bead 26) is removed. To open the container, the user then pries upwardly on the flange 36 causing bead 23 to snap outside shoulder 62. Although the flange 36 is slanted on its bottom surface 37, so that the cap cannot be pried off the neck when the skirt is intact, nevertheless, once the bottom half of the skirt has been torn off, the cap may be removed. Reclosure is performed merely by pushing downward on cap 11 until the bead 23A seats under the shoulder 62.

What is claimed is:

1. A container construction for engagement with a snap-on cap having a skirt having a lower edge and neckengaging means comprising a cylindrical neck, cap-engaging means on said neck including at least one external circumferential bead on said neck a shoulder extending outward from said neck a plurality of circumferentially spaced protuberance extending upward from said shoulder and outward from said neck, said lower edge of said skirt fitting tightly against the tops of said spaced protuberances when said cap-engaging means engages said neck-engaging means, said protuberances being separated by spaces, said spaces being narrow so that one's fingernails cannot be inserted under said lower edge to pry said cap off said neck, a downward extending surface formed below said protrusions with a plurality of outward bulging gripper bumper sections which lie in a common plane and are separated by straight surfaces between said gripper sections, each of said bumper sections being elongated circumferentially, whereby downward pressure of said cap on said neck is resisted by said straight surfaces to resist collapse of said gripper sections.

2. A construction according to claim 1 in which the outer edges of said protuberances are rounded.

3. A construction according to claim 1 in which the widths of such spaces are about equal to the widths of said protuberances.

4. A construction according to claim 1 in which said neck has a thin wall.

5. A construction according to claim 4 in which said wall is of substantially uniform thickness.

6. A construction according to claim 1 wherein said bead has a bead shoulder extending inward substantially radially of said neck, said bead shoulder comprising the bottom of said bead.

7. A construction according to claim 6 in which said neck shoulder extends outward beyond said bead.

8. A container construction for engagement with a snap-on cap having a skirt having a lower edge and neck-engaging means comprising a cylindrical neck, cap-engaging means on said neck including at least one external circumferential bead on said neck cooperable with said neck-engaging means to detachably hold said cap on said neck, a shoulder extending outward from said neck, a plurality of circumferentially spaced protuberances extending upward from said shoulder and outward from said neck having a width in the circumferential direction and a height perpendicular thereto, said lower edge of said skirt fitting tightly against the tops of said protuberances when said cap-engaging means engages said neck-engaging means, said protuberances being separated by spaces and having the height of each protuberance no greater than its width, said spaces being narrow so that one's fingernails cannot be inserted under said lower edge to pry said cap off said neck.

9. A construction according to claim 8 in which the outer edges of said protuberances are rounded.

10. A construction according to claim 8 in which the widths of such spaces are about equal to the widths of said protuberances.

11. A construction according to claim 8 in which said neck has a thin wall.

12. A construction according to claim 8 in which said wall is of substantially uniform thickness.

13. A construction according to claim 8 in which said bead has a bead shoulder extending inward substantially radially of said neck, said bead shoulder comprising the bottom of said bead.

* * * * *